US005307660A

United States Patent [19]

Stoutenburg

[11] Patent Number: 5,307,660

[45] Date of Patent: May 3, 1994

[54] NEW WATER BASED LUBRICANT COMPOSITION FOR COLD IMPACT EXTRUSION OF SPARK PLUG BODIES OR OTHER METAL PARTS AND PROCESS

[75] Inventor: Edmond J. Stoutenburg, Fort Gratiot, Mich.

[73] Assignee: Acheson Industries, Inc., Port Huron, Mich.

[21] Appl. No.: 926,769

[22] Filed: Aug. 6, 1992

[51] Int. Cl.[5] ..... B21B 45/02; C10M 157/02

[52] U.S. Cl. ..... 72/42; 252/49.3; 252/58; 252/56 R; 252/28; 252/25

[58] Field of Search ..... 252/49.3, 18, 58, 56 R, 252/28, 25; 72/42, 46, 47

[56] References Cited

U.S. PATENT DOCUMENTS

| | | | |
|---|---|---|---|
| 3,423,317 | 1/1969 | Lubowitz et al. | 252/49.3 |
| 3,983,042 | 9/1976 | Jain et al. | 252/18 |
| 3,996,143 | 12/1976 | Orkin et al. . | |
| 4,032,678 | 6/1977 | Perfetti et al. | 72/46 |
| 4,048,370 | 9/1977 | Orkin et al. . | |
| 4,053,665 | 10/1977 | Orkin et al. . | |
| 4,129,022 | 12/1978 | Thonnes et al. . | |
| 4,134,842 | 1/1979 | Orkin et al. . | |
| 4,336,150 | 6/1982 | Dorrell | 252/56 R |
| 4,474,669 | 10/1984 | Lewis et al. | 252/49.3 |
| 4,556,498 | 12/1985 | Carbo et al. . | |
| 4,695,492 | 9/1987 | Godar . | |
| 4,752,405 | 6/1988 | Kyle et al. | 252/49.3 |
| 4,861,647 | 8/1989 | Ishikawa et al. . | |
| 4,876,868 | 10/1989 | Tushaus et al. . | |
| 5,061,575 | 10/1991 | Mohri et al. . | |

FOREIGN PATENT DOCUMENTS 2036071 6/1980 United Kingdom .

OTHER PUBLICATIONS

Kirk-Othmer Encyclopedia of Chemical Technology, 3rd Ed., vol. 7, p. 446, (1979).

"Acrysol WS-24" by Rohm and Haas (Nov. 1983).

"Teflon TFE (Teflon 30)" by DuPont Company (date unknown).

*Primary Examiner*—Prince Willis, Jr.

*Assistant Examiner*—Alan D. Diamond

*Attorney, Agent, or Firm*—Dinnin & Dunn

[57] ABSTRACT

A new water based lubricant composition for cold impact extrusion of spark plug bodies or the like, said composition being free of lower molecular weight flammable aliphatic and alicyclic compounds and comprising: an alkaline soluble thermoplastic acrylic resin binder, polytetrafluoroethylene particulate powder material, an alkaline solubilizing agent to maintain the pH of the composition within the range of approximately 8 to 11, a thickening agent, a defoaming agent, and the balance water; and a novel process of cold forming of metal or steel parts.

4 Claims, No Drawings

NEW WATER BASED LUBRICANT COMPOSITION FOR COLD IMPACT EXTRUSION OF SPARK PLUG BODIES OR OTHER METAL PARTS AND PROCESS

BACKGROUND OF THE INVENTION

This invention broadly relates to a new water based lubricant composition for cold impact forming of metal parts, such as spark plug bodies or the like; and, the invention also relates to a new process of cold forming metal parts wherein the lubricant composition can be uniquely removed from the formed metal parts at the end of the metal forming operation. The invention is considered to be broadly applicable to most types of cold forming operations, such as, cold extrusion, cold drawing, cold stamping, swaging, piercing and/or blanking of steel or metal parts.

In the past there have been significant problems, for example in the cold impact extrusion of spark plug bodies, wherein compositions of molybdenum disulfide in water were used as the lubricant coating for the metal bodies prior to the cold forming (i.e., cold impact extrusion) operation. The reasons underlying the problems were at least three-fold. First, the manufacturers have had problems from contamination by molybdenum disulfide dust in the plant work area and such contamination should desirably be eliminated. Second, the molybdenum disulfide lubricant coating was applied in a liquid bath. In this bath there were problems with the molybdenum disulfide pigment settling in the bath, and also, the liquid bath generally had to be maintained at a constant 160° F. temperature which required a great deal of heat energy, and was expensive to maintain. Third, in terms of molybdenum disulfide lubricant removal, the finished and formed metal parts carried a burnished film of molybdenum disulfide which subsequently impeded welding and other operations, which are necessary follow up operations in connection with such metal parts. Therefore, the molybdenum disulfide had to be physically removed, either by etching or grit blasting. The cleaning represented a considerable cost (in time, energy and man power) to the manufacturer. The manufacturers have accordingly desired to eliminate all of the above problem areas.

Accordingly a main object of the present invention is to provide a new water based lubricant composition for cold forming of metal or steel parts.

Another object of the present invention is to provide a new water based lubricant composition which is particularly useful for cold impact extrusion of spark plug bodies.

Another object of the present invention is to provide a new water based lubricant composition for cold forming of metal parts, and which enables a clean manufacturing operation to be carried out, while at the same time providing a lubricant composition which can be efficiently and economically removed from the parts at the conclusion of the metal forming operation.

Still another object of the present invention is to provide a novel process of cold forming metal parts, such as steel spark plug bodies, and other steel or metal parts.

Other objects, features and advantages of the present invention will become apparent from the subsequent description and the appended claims.

SUMMARY OF THE INVENTION

Briefly stated, the present invention involves a water based lubricant composition for cold impact forming of metal parts, said composition being free of lower molecular weight flammable aliphatic and alicyclic compounds, said composition comprising about 3% to about 25% by weight of an alkaline soluble thermoplastic acrylic resin binder, about 3% to about 20% by weight of polytetrafluoroethylene particulate powder material, about 0.1% to about 12% by weight of an alkaline solubilizing agent to maintain the pH of the composition within the range of approximately 8 to 11, about 0.01% to 6% by weight of a thickening agent, about 0.01% to 2% by weight of a defoaming agent, and the balance water.

From a process aspect, briefly stated, the present invention involves a process of cold forming metal parts, such as steel spark plug bodies or the like, comprising the steps of: 1) preheating the metal parts to a temperature between about 125° F. and about 170° F. (preferably about 130°-145° F.) by immersion in hot water; 2) coating said metal parts with a water based lubricant coating composition comprised of about 3% to about 25% by weight of an alkaline soluble thermoplastic acrylic resin binder, about 3% to about 20% by weight of polytetrafluoroethylene particulate powder material, about 0.1% to about 12% by weight of an alkaline solubilizing agent to maintain the pH of the composition within the range of about 8 to about 11, zero to about 6% by weight of a thickening agent, zero to about 2% by weight of a defoaming agent, and the balance water; 3) air drying the metal parts; 4) forming the coated metal parts in a cold forming machine to make the formed metal parts; and 5) subjecting the metal parts to a caustic wash and water rinse to remove residual resin and PTFE lubricant.

DESCRIPTION OF PREFERRED EMBODIMENTS

The resin binder used in this invention should be an alkaline soluble thermoplastic acrylic resin binder. Suitable resins for this purpose are: acrylic resin binders known as: Acrysol® WS-24; Joncryl Acrylic Resin No. 60; and Carboset 525 Acrylic Resin. The amount of the acrylic resin binder used should broadly be within the range of about 3% to about 25% by weight of the water based lubricant composition; preferably the amount should be within the range of about 5% to about 15% by weight, and best results are obtained when the acrylic resin binder is present within the range of about 11% to about 13% by weight of the lubricant composition.

The polytetrafluoroethylene portion of the lubricant composition should be a polytetrafluoroethylene (PTFE) particulate powder or powder dispersion material. Suitable types of such PTFE materials for use in this invention are: Teflon 30, Vydax, Whitcon TL-102-2, Fluon AD-1, and other commercially available high density PTFE powders. The polytetrafluoroethylene powder should be present within the lubricant composition, broadly stated, within the range of about 3% to about 20% by weight of the composition, and preferably it should be present within the range of about 4% to about 10% by weight of the composition, with best results being obtained when the polytetrafluoroethylene is present within the range of about 5% to about 7% by weight of the composition.

The alkaline solubilizing agent used in the lubricant composition should preferably be ammonium hydroxide, however, other caustic materials may be used such as sodium hydroxide, or the like. Broadly stated the alkaline solubilizing agent should be present in the composition within the range of about 0.1% to about 12% by weight of the composition and in sufficient amount to adjust the pH of the composition to approximately 8 to 11. Preferably the alkaline solubilizing agent should be present in the composition within the range of about 0.1% to about 4% by weight, and in an amount sufficient to adjust the pH of the composition to a point between approximately 8.5 and 10. Best results are obtained when the alkaline solubilizing agent is present in the composition within the range of about 0.2% to about 3% and with the pH falling within the range of about 9 to about 9.5.

The thickening agent used in the lubricant composition can be any one (or a combination) of the following materials: carboxymethylcellulose, polysaccharides, hydroxyethylcellulose, bentone, clay, silica (such as fumed silica), polyox, and an acrylic emulsion copolymer (such as Rohm & Haas Co. ASE-95). Broadly stated, the thickening agent may be present in the lubricant composition within the range of 0.01% to about 6% by weight of the composition. Preferably it should be present within the range of about 0.01% to about 4% by weight; and, best results are obtained when the thickening agent is present within the range of about 0.2% to about 1% by weight of the composition.

The defoaming agent (or anti-foam agent) used in the invention can suitably be any one of the following materials: silicone emulsions (such as SWS-214 dimethyl siloxane emulsion from Stauffer Chemical Company); vegetable oil emulsions (such as GP No. 440 of Genessee Polymer Company); high molecular weight alcohols (e.g., octyl alcohol or Texanol). Broadly stated the defoaming agent should be present in the lubricant composition within the range of about 0.01% to about 2% by weight of the composition. Preferably it should be present within the range of about 0.01% to about 1% by weight, and best results have been obtained when the defoaming agent is present within the range of about 0.05% to about 0.3% by weight of the composition.

Other additives may optionally be present in the lubricant composition, such as pigment fillers: talc, mica, and boron nitride; anti-corrosion agents such as: amines, amine borates, and carboxylic acid salts; and preservatives such as Grotan® (available from Lehn & Fink Products Group). Also lubricity additives may be optionally used such as: polypropylene emulsions (e.g., Eastman Product No. E-43), and polyethylene emulsions (such as Allied Product No. AC-629).

In order to further illustrate the invention, the following examples are provided. It is to be understood, however, that the examples are included for illustrative purposes and are not intended to be limiting to the scope of the invention as set forth in the subjoined claims.

EXAMPLE 1

| Component | Percent by Weight |
|---|---|
| Water | 57.7% |
| Acrysol WS-24* (alkaline soluble thermoplastic acrylic resin binder) | 30.0% |
| ASE-95* (thickening agent) | 1.0% |
| Ammonium hydroxide (concentration 30% $NH_3$ in water) | 1.2% |
| PTFE Pigment (Teflon 30) (Dupont Co.) | 10.0% |
| SWS-214 (dimethyl siloxane) (defoaming agent) (Thompson-Hayward Chemical Co.) | 0.1% |
| | 100.0% |

*Rohm & Haas Co.

The procedure for preparing the above lubricant coating composition (and the remaining examples as well) is to, first, blend the ingredients in the order listed above, and secondly, adjust the pH to 9.0 by slight further addition of ammonia if necessary.

The resulting lubricant coating composition shown immediately above was coated onto spark plug billets of various sizes. The billets were then formed in a cold impact extrusion apparatus. The quality of the finished plug bodies was excellent. Cleaning of the parts was done by dipping the parts in an alkali rinse, and no other cleaning was required. Subsequent operations required no additional etching or grit blasting. The lubricant bath did not have to be heated for coating, thus eliminating that cost as well. The coating was found to be unique in its performance and highly advantageous for use in lubricating the steel parts prior to cold forming.

EXAMPLE 2

| Component | Percent by Weight |
|---|---|
| Water | 57.7% |
| Acrysol WS-24 (alkaline soluble thermoplastic acrylic resin binder) | 30.0% |
| ASE-95 (thickening agent) | 1.0% |
| Ammonia | 1.2% |
| Teflon 30 | 10.0% |
| DM-4130 Anti-foam agent | 0.1% |
| | 100.0% |
| Evaluation | |
| Solids | 17.5% |
| Viscosity | 40 cps |
| pH | 9.0 |

EXAMPLE 3

| Component | Percent by Weight |
|---|---|
| Water | 57.7% |
| Acrysol WS-24 (alkaline soluble thermoplastic acrylic resin binder) | 30.0% |
| ASE-95 (thickening agent) | 1.0% |
| Ammonia | 1.2% |
| Teflon 30 | 10.0% |
| Balab 3056A (anti-foam agent) | 0.1% |
| | 100.0% |
| Evaluation | |
| Solids | 17.5% |
| Viscosity | 40 cps |
| pH | 9.0 |

EXAMPLE 4

| Component | Percent by Weight |
|---|---|
| Water | 57.7% |
| Acrysol WS-24 (alkaline soluble thermoplastic acrylic resin binder) | 30.0% |
| ASE-95 (thickening agent) | 1.0% |
| Ammonia | 1.2% |
| Teflon 30 | 10.0% |
| Foam Ban MS-30 (anti-foam agent) (Ultra Additives, Inc.) | 0.1% |
| | 100.0% |
| Evaluation | |
| Solids | 17.6% |
| Viscosity | 45 cps |
| pH | 9.1 |

EXAMPLE 5

| Component (stir together) | Percent by Weight |
|---|---|
| Water | 61.6% |
| Acrysol WS-24 (alkaline soluble thermoplastic acrylic resin binder) | 30.0% |
| ASE-95 (thickening agent) | 1.0% |
| Ammonia | 1.2% |
| Whitcon TL-102-2 PTFE (I.C.I. Chemical Co./U.S. division) | 6.0% |
| Foam Ban MS-30 | 0.1% |
| Grotan (preservative) (Lehn & Fink) | 0.1% |
| | 100.0% |
| Evaluation | |
| Solids | — |
| Viscosity | 50 cps |
| pH | 8.6 |

EXAMPLE 6

| Component (pebble mill) | Percent by Weight |
|---|---|
| Water | 61.6% |
| Acrysol WS-24 (alkaline soluble thermoplastic acrylic resin binder) | 30.0% |
| ASE-95 (thickening agent) | 1.0% |
| Ammonia | 1.2% |
| Whitcon TL-102-2 PTFE | 6.0% |
| Foam Ban MS-30 | 0.1% |
| Grotan | 0.1% |
| | 100.0% |
| Evaluation | |
| Solids | 17.25% |
| Viscosity | 40 cps |
| pH | 8.8 |

EXAMPLE 7

| Component | Percent by Weight |
|---|---|
| Water | 57.6% |
| Joncryl 60 (S.C. Johnson Wax Co.) | 30.0% |
| ASE-95 (thickening agent) | 1.0% |

-continued

| Component | Percent by Weight |
|---|---|
| Ammonia | 1.2% |
| Teflon-30 | 10.0% |
| Grotan | 0.1% |
| Foam Ban MS-30 | 0.1% |
| | 100.0% |
| Evaluation | |
| Solids | 16.89% |
| Viscosity | 30 cps |
| pH | 9.2 |

While it will be apparent that the preferred embodiments of the invention disclosed are well calculated to fulfill the objects, benefits, and advantages of the invention, it will be appreciated that the invention is susceptible to modification, variation and change without departing from the proper scope or fair meaning of the subjoined claims.

What is claimed is:

1. A process of cold forming metal parts, comprising the steps of:

(1) preheating the metal parts to a temperature between about 125° F. and about 170° F. by hot water immersion, (2) coating said metal parts with a water based lubricant coating composition comprised of:

(a) about 3% to about 25% by weight of an alkaline soluble thermoplastic acrylic resin binder, (b) about 3% to about 20% by weight of polytetrafluoroethylene particulate powder material, (c) about 0.1% to about 12% by weight of an alkaline solubilizing agent to maintain the pH of the composition within the range of about 8 to about 11, (d) zero to about 6% by weight of a thickening agent, (e) zero to about 2% by weight of a defoaming agent, (f) the balance water, (3) air drying said metal parts, (4) forming the coated metal parts in a cold forming machine to make the formed metal parts, (5) subjecting the metal parts to a caustic wash and water rinse to remove the residual resin and polytetrafluoroethylene lubricant.

2. The process of claim 1 wherein, said caustic wash is done with a liquid caustic having a pH of about 10 to about 12, and wherein, said acrylic resin binder is present from about 5% to about 15%, said polytetrafluoroethylene material is present from about 4% to about 10%, said alkaline solubilizing agent is present from about 0.1% to about 4%, said thickening agent is present from about 0.01% to about 4%, said defoaming agent is present from about 0.01% to about 1%, and said pH is about 8.5 to about 10.

3. The process of claim 1 wherein, thickening agent is present from about 0.2% to about 1%, said defoaming agent is present from about 0.05% to about 0.3%.

4. The process of claim 1 wherein, the thickening agent is selected from at least one of the group consisting of, polysaccharide, an acrylic emulsion copolymer, bentone, silica and clay.

* * * * *